US006257971B1

(12) United States Patent
Takahashi et al.

(10) Patent No.: US 6,257,971 B1
(45) Date of Patent: Jul. 10, 2001

(54) APPARATUS FOR POLISHING END SURFACE OF OPTICAL FIBERS

(75) Inventors: Mitsuo Takahashi, Matsudo (JP); Joseph Straus, Nepean (CA)

(73) Assignees: Seikoh Giken Co., LTD, Chiba-ken (JP); JDS Fitel Inc., Ontario (CA)

( * ) Notice: Subject to any disclaimer, the term of this patent is extended or adjusted under 35 U.S.C. 154(b) by 0 days.

(21) Appl. No.: 08/967,303

(22) Filed: Oct. 21, 1997

Related U.S. Application Data

(63) Continuation of application No. 08/389,414, filed on Feb. 16, 1995, now abandoned.

(30) Foreign Application Priority Data

Oct. 7, 1994 (JP) ..... 6-270529

(51) Int. Cl.[7] ..... B24B 41/06
(52) U.S. Cl. ..... 451/365; 451/460
(58) Field of Search ..... 451/364, 365, 451/405, 391, 41, 386–387, 389–390, 384, 66, 460, 366

(56) References Cited

U.S. PATENT DOCUMENTS

| | | | | |
|---|---|---|---|---|
| 2,740,240 | * | 4/1956 | Rugels | 451/370 |
| 2,842,906 | * | 7/1958 | Carter et al. | 451/364 |
| 4,819,386 | * | 4/1989 | Struyf | 451/365 |
| 4,831,784 | | 5/1989 | Takahashi . | |
| 4,905,415 | * | 3/1990 | Moulin | 451/390 |
| 4,979,334 | | 12/1990 | Takahashi . | |
| 5,140,779 | * | 8/1992 | Grois | 451/391 |
| 5,216,846 | * | 6/1993 | Takahashi | 451/278 |
| 5,351,445 | | 10/1994 | Takahashi . | |

FOREIGN PATENT DOCUMENTS

| | | | | |
|---|---|---|---|---|
| 107229 | * | 6/1916 | (GB) | 451/364 |
| 4176557 | * | 6/1972 | (JP) | 451/364 |
| 57-127656 | * | 8/1982 | (JP) | 451/41 |
| 59-161256 | * | 9/1984 | (JP) | 451/41 |
| 3-234457 | * | 10/1991 | (JP) | 451/387 |

* cited by examiner

*Primary Examiner*—Robert A. Rose
(74) *Attorney, Agent, or Firm*—Venable; Robert J. Frank; Michael A. Sartori

(57) ABSTRACT

An apparatus for simultaneously or selectively grinding ends of a plurality of optical fibers held by optical fiber end devices such as connectors including ferrules. The apparatus has a holder plate having a plurality of types of supporting structures for fixing and supporting a plurality of types of optical fiber end devices with optical fibers connected thereto. Spring or weights are used for urging ends of the optical fibers on the optical fiber end devices supported by the supporting structures. A circular-path-based relative motion is caused to occur between the holder plate and the grinding plate. Each of the optical fiber end devices is a connector including a ferrule. In such a case, the plurality of types of optical fiber end devices may be connectors whose end surfaces are to be ground at different angles or may be the connectors of different connection types. The circular-path-based relative movement has a rotation component which is rotation of the holder plate about its own axis and a revolution movement which is revolution of the axis of the holder plate. The supporting structures of each type are preferably arranged on a circle concentric with the axis of the holder plate and preferably at a constant angular interval.

14 Claims, 2 Drawing Sheets

II – II

III – III

V – V

APPARATUS FOR POLISHING END SURFACE OF OPTICAL FIBERS

This application is a continuation of application Ser. No. 08/389,414, filed Feb. 16, 1995 now abandoned.

BACKGROUND OF THE INVENTION

1. Field of the Invention

The present invention relates to an apparatus for simultaneously grinding or polishing end surfaces of a plurality of optical fibers which are connected to respective fiber end devices.

More specifically, the present invention is concerned with an apparatus for simultaneously or independently grinding the end surfaces of different types of optical fibers connected to a variety of types of fiber end devices which are often used at sites where optical fiber cable is laid.

2. Prior Art

TAKAHASHI, one of the inventors of the present invention, has made many proposals in regard to grinding of end surfaces of optical fibers. For instance, the following patents and patent application pertain to grinding apparatuses capable of simultaneously grinding end surfaces of a plurality of optical fibers:

U.S. Pat. No. 4,831,784

POLISHING APPARATUS FOR END SURFACES OF OPTICAL FIBERS

U.S. Pat. No. 4,979,334

OPTICAL FIBER END SURFACE POLISHING DEVICE

U.S. Pat. No. 5,216,846

METHOD AND APPARATUS FOR GRINDING FOREMOST END OF FERRULE

Japanese Patent Laid-Open No. 6-179161; U.S. Ser. No. 08/019,303

APPARATUS FOR GRINDING ENDFACES OF FERRULES TOGETHER WITH OPTICAL FIBERS EACH FIRMLY RECEIVED IN FERRULE

The grinding apparatuses proposed in these patents and patent application are of the type in which the end surfaces of the optical fibers to be ground are pressed against the grinding plate, and a synthetic relative movement having a rotational component (rotation about fixed axis) and a revolution component (revolution along an orbit) is caused between the grinding plate and the optical fiber end surfaces, thereby grinding these end surfaces.

FIG. 4 is a plan view of a grinding holder of a known apparatus for grinding end surfaces of a plurality of optical fibers. The grinding holder has a holder plate capable of holding fiber end devices of different types one of which is illustrated in sectional view in FIG. 5.

The holder plate 1 is provided at its center with a cylindrical hub 2 for receiving a holder shaft. The holder plate 1 is further provided with a plurality of mounting members 3 which are designed to mount fiber end devices of the same configuration. These mounting members are arranged on a circle E shown by a chain line and concentric with the holder plate 1.

More specifically, FIG. 5 is a sectional view taken along the line V—V of FIG. 4, and the mounting member 3 shown therein is adapted to mount an FC-type ferrule 5 which receives an end of an optical fiber 4. The end surface of an optical fiber 4 exposed from the ferrule 5, is to be ground perpendicularly to the axis of the optical fiber.

To explain in more detail, a plurality of through-holes 7 are formed on the above-mentioned circle E. A ferrule receiving sleeve 8 for receiving the ferrule 5 is press-fit in each hole 7. Namely, the ferrule receiving sleeve 8 has a through bore for receiving the ferrule 5 and is externally threaded at 8*a*. A nut 9 has a slit 10 and is internally threaded so as to be screwed to the above-mentioned external thread 8*a* thereby fixing the FC-type ferrule 5.

The end surfaces 6 of the FC-type ferrules 5 are pressed against a grinding plate 11, and a relative movement based on a circular path is caused to occur between the end surfaces of the ferrules 5 and the grinding plate 11, so that the end surfaces of six optical fibers are simultaneously ground.

Nowadays, various types of optical fiber connectors are used, such as FC type, SC type, ST$^R$ type, DIN type, MT type and so forth. Furthermore, these connectors are grouped according to the shape in which the ferrule end is ground, e.g., spherical surface with vertical axis, spherical surface inclined with respect to vertical plane, and so forth. Thus, more than 20, almost 30 types of optical fiber connectors exist according to the combination of the connector type and the shape of grinding, requiring different specifications or types of grinding work. Hitherto, different types of grinding holder plates have had to be prepared and used, adapted to each of the variety of types of the optical fiber end devices of different designs.

The grinding holder plate is one of the most critical components of the grinding apparatus, since it controls the precision of grinding of the optical fiber end surfaces. In general, therefore, a grinding holder plate has to be finished with a high degree of precision on the order of 1 $\mu$m. Thus, the grinding holder plate is one of the most expensive components. It may be not so difficult to prepare many different types of holder plates in a factory where limited types of fiber end devices are to be ground in large quantities. However, a difficulty is encountered at sites where a variety of types of fiber end devices have to be ground in small lots. Obviously, preparation and use of many different grinding holder plates at each of sites is disadvantageous from the view points of cost, transportation and administration. This has given a rise to the demand for an optical fiber end surface grinding apparatus in which a single grinding holder plate can be adapted to a variety of types of optical fibers.

SUMMARY OF THE INVENTION

Accordingly, an object of the present invention is to provide an improved apparatus for grinding end surfaces of optical fibers, capable of simultaneously grinding the end surfaces of a plurality of types of optical fibers by means of a single grinding holder plate.

To this end, according to the present invention, there is provided an apparatus for use in simultaneously grinding a plurality of optical fibers each respectively connected to one of a plurality of optical fiber end devices. At least a first one and a second one of the plurality of optical fiber end devices are dissimilar. The apparatus includes a holder plate, at least one first supporting structure disposed on the holder plate and adapted to fix and support the first one of the plurality of optical fiber end devices, and at least one second supporting structure disposed on the holder plate and adapted to fix and support the second one of the plurality of optical fiber end devices.

Each of the optical fiber end devices may be a connector including a ferrule. In such a case, the plurality of types of optical fiber end devices may be connectors whose end surfaces are to be ground at different angles or may be the connectors of different connection types.

The circular-path-based relative movement caused by the driving means may have a rotation component which is rotation of the holder plate about its own axis and a revolution movement which is revolution of the axis of the holder plate.

The supporting structures of each type are preferably arranged on a circle concentric with the axis of the holder plate and preferably at a constant angular interval.

These and other objects, features and advantages will become clear from the following description when the same is read in conjunction with the accompanying drawings.

DETAILED DESCRIPTION OF THE PREFERRED EMBODIMENTS

Figure 1:
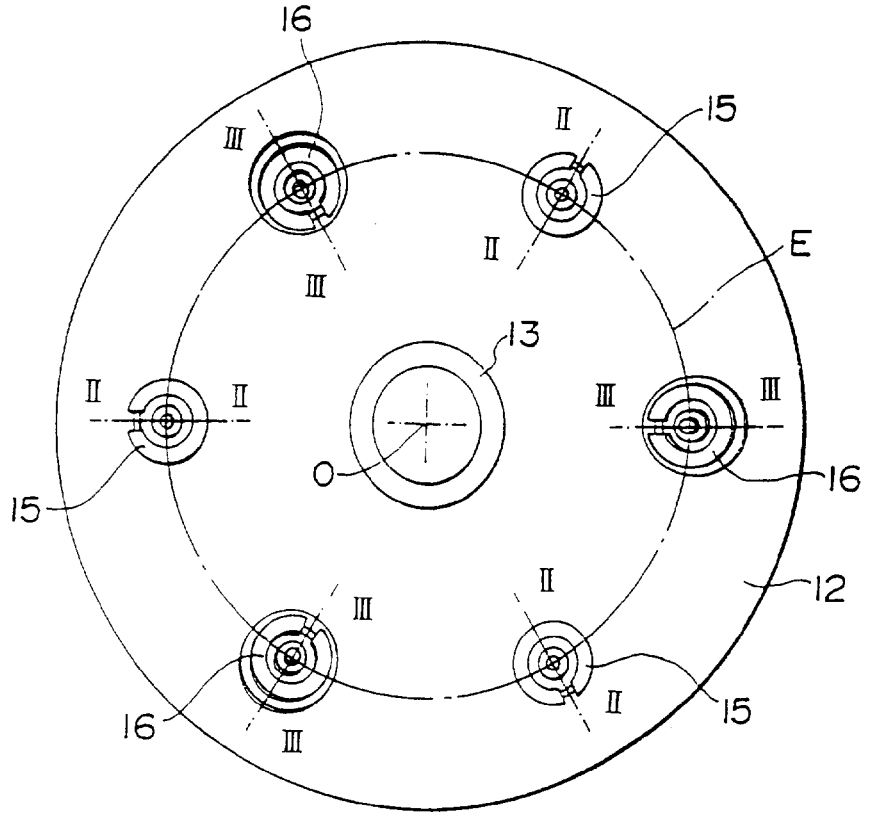
FIG. 1 is a plan view of an embodiment of the grinding apparatus of the present invention for simultaneously grinding end surfaces of different types of optical fibers.
Figure 2:
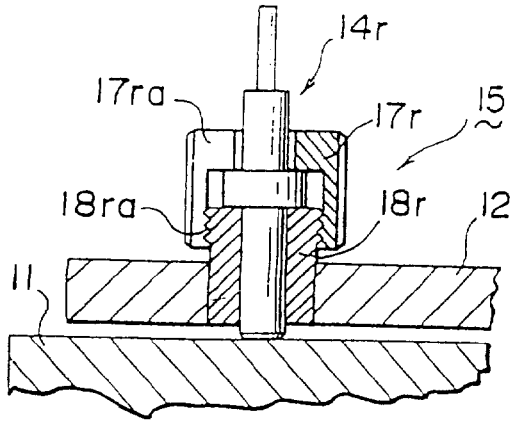
FIGS. 2 and 3 are sectional views of a critical portion of the apparatus shown in FIG. 1, illustrating the manner in which the ends of a plurality of types of optical fiber end devices are supported by a grinding holder plate of the apparatus.
Figure 3:
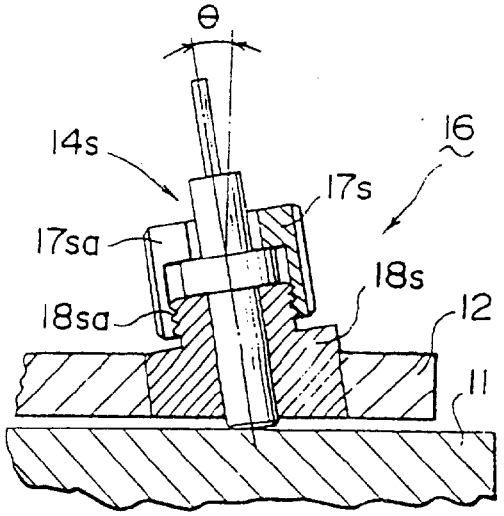
Figure 4:
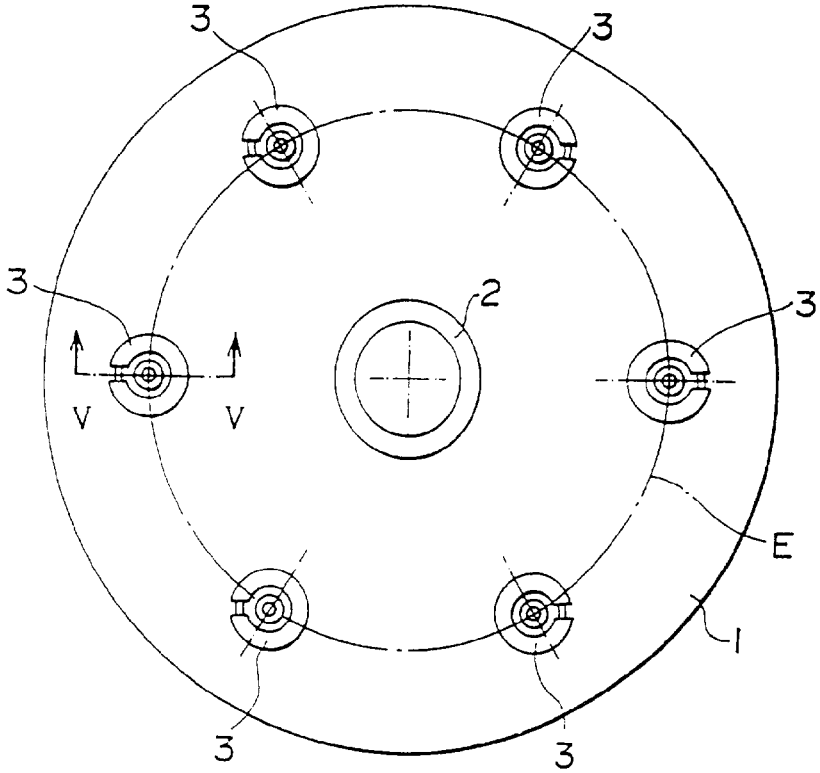
FIG. 4 PRIOR ART
FIG. 4 is a plan view of a conventional grinding apparatus of the present invention for simultaneously grinding end surfaces of a plurality of optical fibers.
Figure 5:
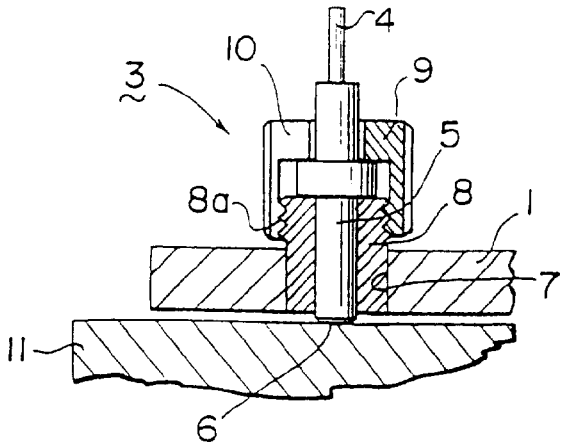
FIG. 5 PRIOR ART
FIG. 5 is a sectional view of a critical portion of the conventional apparatus of FIG. 4, illustrating the manner in which the ends of a plurality of types of optical fiber end devices are supported by a grinding holder plate of the apparatus.

A preferred embodiment of the present invention will be described with reference to FIGS. 1 and 3.

The term "optical fiber end device" in this specification is intended to cover various types of devices to which optical fibers are connected, in particular but not exclusively connectors including ferrules. Thus, the optical fiber end device, typically connectors including ferrules, may be of different types of connection and may have different appearances, and the apparatus of the present invention can simultaneously and independently grind the end surfaces of optical fibers connected to such optical fiber end device.

The illustrated embodiment comprises a holder plate 12 having a plurality of supporting structures for supporting optical fiber end devices. More specifically, there are two types of supporting structures 15, 16 which are adapted to support different types of optical fiber end devices with optical fibers connected thereto. Each of the first-type supporting structure 15, referred to also as "perpendicular grinding supporting structure", is adapted for fixing and supporting an FC type ferrule 14*r* with an optical fiber connected thereto, for grinding the end of the optical fiber perpendicularly to the fiber axis. On the other hand, each of the second-type supporting structures 16, referred to also as "tapered grinding supporting structure", is adapted to fix and support an FC-type ferrule 14*s* with an optical fiber connected thereto for grinding in a taper or a plane which is inclined with respect to the plane perpendicular to the fiber axis.

The perpendicular grinding supporting structure 15 includes a ferrule receiving sleeve 18*r* and a nut 17*r*. The ferrule receiving sleeve 18*r* is fixed in one of a plurality of through-holes formed in a holder plate 12 along a circle E shown by a dash line and concentric with the holder plate 12. The ferrule-receiving sleeve 18*r* has a central bore for receiving the FC-type ferrule (for perpendicular grinding) 14*r* with optical fiber connected thereto, and is externally threaded as at 18*ra* at portions thereof outside the through-hole. The nut 17*r* has a slit 17*ra* and an internal screw thread which is adapted to engage with the external thread 18*ra* of the ferrule receiving sleeve, so as to tighten the FC type ferrule 14*r*.

Similarly, the taper grinding supporting structure 16 includes a ferrule receiving sleeve 18*s* and a nut 17*s*. The ferrule receiving sleeve 18*s* is fixed in one of a plurality of through-holes formed in a holder plate 12 along the circle E, such that the axis of the through-hole is inclined at an angle θ with respect to a vertical plane. The ferrule-receiving sleeve 18*s* has a central bore for receiving the FC-type ferrule (for taper grinding) 14*s* with optical fiber connected thereto, and is externally threaded as at 18*sa* at portions thereof outside the through-hole. The nut 17*s* has a slit 17*sa* and an internal screw thread which is adapted to engage with the external thread 18*sa* of the ferrule receiving sleeve, so as to tighten the FC type ferrule 14*s*.

The supporting structures 15, 16 for supporting different types of fiber end devices may be arranged on different circles concentric with the holder plate 12. Namely, for instance, the supporting structures 15 for perpendicular grinding and the supporting structures 16 for taper grinding may be arranged on different circles which are concentric with each other and with the center of the holder plate 12. However, it is preferred that the supporting structures of the same type are arranged on the same circle, in order to attain uniform grinding effect.

For the same reason, it is desirable that the supporting structures of each type are arranged at a regular angular interval, e.g., 120°, so as to attain uniform finishing of the ground surface.

Urging means which are not illustrated urges the end surfaces of the optical fibers in the optical fiber end devices carried by the holder plate 12 against the grinding plate 11.

The grinding plate 11 is an elastic disk having a grinding cloth placed thereon, and it is possible to grind the end surfaces of the ferrules and the optical fibers into spherical form. A spring or a weight can be used as the above-mentioned urging means.

Although not shown, driving means are provided to cause a circular-path-based relative movement to occur between the holder plate 12 and the grinding plate 11. More specifically, the relative motion caused by the driving means has two components. These components are, when viewed from the grinding plate 11, rotation of the holder plate 12 about its axis and revolution of the axis of the holder plate 12 along an orbit which may be centered at the center of the grinding plate 11.

Although a specific embodiment has been described, it is to be understood that the described embodiment is only illustrative and various changes and modifications may be imparted thereto without departing from the scope of the invention. In addition, factors such as planar configuration of the grinding holder plate 12, method of applying grinding load, and structure for holding the same may be suitably designed according to requirements and conditions.

Furthermore, the invention can be applied to all the grinding apparatuses which have been proposed by TAKAHASHI who is one of the inventors of the present invention.

Although in the described embodiment the supporting structures 15, 16 are press-fit in the through-holes formed in the holder plate 12, such a manner of fixing is only illustrative and the arrangement may be modified so that either one or both of these two types of supporting structures are screwed or otherwise detachably secured to the holder plate 12. It is also possible to use any suitable arrangement for tightening the optical fiber end devices, in place of the nuts used in the described embodiment.

As has been described, according to the invention, a plurality of types of supporting structures are provided on a common holder plate of the optical fiber end surface grinding apparatus of the present invention, so that a plurality of, at least two, types of optical fiber end devices can be simultaneously or selectively ground, polished and finished at a high degree of quality.

The apparatus of the present invention is particularly effective when used at sites where optical fiber cables are laid, and where grinding of end surfaces of a variety of types of optical fibers is necessary, but is also used advantageously in factories where end surfaces of many different types of optical fibers are to be ground, since it is not necessary to prepare and use exclusive holder plates for each type of the optical fibers.

Thus, the present invention offers remarkable advantages in saving costs for equipment, transportation and administration, thus unburdening those who are engaged in processing of optical fiber ends.

What is claimed is:

1. An apparatus for use in simultaneously grinding a plurality of optical fibers each respectively connected to one of a plurality of optical fiber end devices, at least a first one and a second one of the plurality of optical fiber end devices being dissimilar, comprising:

a holder plate;

at least one first supporting-structure including a first ferrule receiving sleeve being fixedly and rigidly secured in one of a plurality of through-holes formed in the holder plate, to surround the exterior surface of a first ferrule, and adapted to fix and support the first one of the plurality of optical fiber end devices demountably at a first angle relative to the holder plate; and at least one second supporting structure having a different external form from that of the first supporting structure including a second ferrule receiving sleeve being fixedly and rigidly secured in one of a plurality of through-holes formed in the holder plate, to surround the exterior surface of a second ferrule, and adapted to fix and support the second one of the plurality of optical end devices demountably at a second angle relative to the holder plate, different from said first angle, whereby the respective optical fibers connected to the first one and the second one of the plurality of optical fiber end devices are simultaneously ground, wherein said at least one first and said at least one second supporting structures are arranged substantially on a circle concentric with an axis of said holder plate.

2. An apparatus as defined in claim 1, wherein the plurality of optical fiber end devices comprises connectors including ferrules, said at least one first supporting structure fixes and supports the first one of said plurality of optical fiber end devices so that an end surface of the respective optical fiber connected thereto is disposed at said first angle relative to said holder plate, and said at least one second supporting structure fixes and supports the second one of said plurality of optical fiber end devices so that an end surface of the respective optical fiber connected thereto is disposed at said second angle relative to said holder plate.

3. An apparatus as defined in claim 1, wherein said at least one first and said at least one second supporting structures are arranged at constant angular intervals on the circle.

4. An apparatus as defined in claim 1, wherein said at least one first supporting structure comprises a plurality of first supporting structures, and said at least one second supporting structure comprises a plurality of second supporting structures.

5. An apparatus as defined in claim 4, wherein said plurality of first and said plurality of second supporting structures are alternatingly arranged around the circle.

6. An apparatus as defined in claim 4, wherein said plurality of first and said plurality of second supporting structures are arranged symmetrically on said holder plate, whereby a pressure applied is evenly distributed to one end surface of each of the plurality of optical fibers.

7. An apparatus as defined in claim 4, wherein said plurality of first supporting structures are arranged at a first constant angular interval, and said plurality of second supporting structures are arranged at a second constant angular interval.

8. An apparatus as defined in claim 7, wherein the first constant angular interval and the second constant angular interval are essentially identical.

9. An apparatus as defined in claim 4, wherein each of said first supporting structures fixes and supports the respective first optical fiber end and device so that an end surface of the respective optical fiber connected thereto is disposed at said first angle with respect to the holder plate, and each of said second supporting structures fixes and supports the respective second optical fiber end device so that an end surface of the respective optical fiber connected thereto is disposed at a second grinding angle with respect to the holder plate.

10. An apparatus as defined in claim 1, wherein each of said first and second ferrule receiving sleeves are adapted to receive the respective optical fiber end device, said sleeve having a first end insertable into said holder plate and a second end opposite to the first end, the second end being threaded; and wherein at least one of said at least one first supporting structure and said at least one second supporting structure further comprises a nut threaded onto said second end of said sleeve for retaining the optical fiber end device within each said sleeve.

11. An apparatus as defined in claim 1, further comprising a grinding plate positioned essentially parallel to said holder plate for simultaneously engaging with one end surface of each of the plurality of optical fibers.

12. A method of simultaneously grinding and evenly distributing a pressure on the respective one end surface of each of the plurality of optical fibers to evenly grind the respective one end surface with the grinding plate, which comprises utilizing the apparatus as defined in claim 11.

13. An apparatus as defined in claim 2, wherein said at least one first supporting structure fixes and supports the first one of said plurality of optical fiber end devices so that an end surface of the respective optical fiber connected thereto is disposed at said first angle perpendicular to said holder plate.

14. An apparatus for use in simultaneously grinding a plurality of optical fibers each respectively connected to one of a plurality of optical fiber end devices, at least a first one and a second one of the plurality of optical fiber end devices being dissimilar, comprising:

a holder plate including means for evenly distributing a pressure on one end surface of each of the plurality of optical fibers;

at least one first supporting means being fixedly and rigidly secured in one of a plurality of through-holes formed in the holder plate and surrounding the exterior surface of a first ferrule for fixing and supporting the first one of the plurality of optical fiber end devices demountably at a first angle relative to the holder plate; and at least one second supporting means having a different external form from that of the first supporting means being fixedly and rigidly secured in one of a plurality of through-holes formed in the holder plate and surrounding the exterior surface of a second ferrule for fixing and supporting the second one of the plurality of optical fiber ferrules demountably at a second angle relative to the holder plate, different from said first angle, whereby the respective optical fibers connected to the first one and the second one of the plurality of optical fiber end devices are simultaneously ground, wherein said at least one first and said at least one second supporting means are arranged substantially on a circle concentric with an axis of said holder plate.

* * * * *